US006247391B1

(12) United States Patent
Murao et al.

(10) Patent No.: US 6,247,391 B1
(45) Date of Patent: Jun. 19, 2001

(54) COMPRESSOR AND SPRING POSITIONING STRUCTURE

(75) Inventors: Kazushige Murao; Fuminobu Enokijima, both of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/390,845

(22) Filed: Sep. 7, 1999

(30) Foreign Application Priority Data

Sep. 10, 1998 (JP) ..... 10-256397

(51) Int. Cl.[7] ..... F16F 1/04; F04B 27/08

(52) U.S. Cl. ..... 92/71

(58) Field of Search ..... 92/12.2, 71; 91/499; 417/269

(56) References Cited

U.S. PATENT DOCUMENTS

| | | | | |
|---|---|---|---|---|
| 3,945,765 | * | 3/1976 | Toyoda et al. | 417/269 |
| 4,581,980 | * | 4/1986 | Berthold | 92/12.2 |
| 4,703,682 | * | 11/1987 | Hansen | 92/12.2 |
| 4,784,045 | * | 11/1988 | Terauchi | 417/269 |
| 4,886,423 | * | 12/1989 | Iwanami et al. | 92/12.2 X |
| 4,973,229 | * | 11/1990 | Oono et al. | 92/12.2 X |
| 4,982,651 | * | 1/1991 | Kanamaru et al. | 91/499 |
| 5,055,004 | * | 10/1991 | Ebbing et al. | 92/12.2 X |
| 5,094,590 | * | 3/1992 | Carella et al. | 92/71 X |
| 5,129,752 | * | 7/1992 | Ebbing et al. | 92/12.2 X |
| 5,415,077 | * | 5/1995 | Ono | 92/71 |
| 5,752,428 | * | 5/1998 | Jepsen | 91/499 |
| 5,779,004 | * | 7/1998 | Hoshino et al. | 92/71 X |
| 5,784,950 | * | 7/1998 | Kayukawa et al. | 92/71 |
| 5,857,402 | * | 1/1999 | Hoshida et al. | 92/12.2 |
| 5,941,159 | * | 8/1999 | Hansell et al. | 92/71 |
| 5,941,161 | * | 8/1999 | Kimura et al. | 92/71 X |
| 5,953,980 | * | 9/1999 | Ota et al. | 92/71 |
| 6,146,107 | * | 11/2000 | Kawaguchi et al. | 92/12.2 X |

FOREIGN PATENT DOCUMENTS

| | | | | |
|---|---|---|---|---|
| 627484 | * | 5/1963 | (BE) | 417/269 |
| 195 08 979 | | 11/1995 | (DE) . | |
| 0 844 392 | | 5/1998 | (EP) . | |
| 497 734 | | 3/1937 | (GB) . | |
| 1 042 117 | | 9/1966 | (GB) . | |
| 54-58555 | | 4/1979 | (JP) . | |
| 64-43241 | | 3/1989 | (JP) . | |
| 1-307530 | | 12/1989 | (JP) . | |
| 6-241163 | * | 8/1994 | (JP) | 417/269 |

* cited by examiner

*Primary Examiner*—John E. Ryznic
(74) *Attorney, Agent, or Firm*—Morgan & Finnegan, LLP

(57) ABSTRACT

A support spring including a front end having a small diameter and a rear end having a large diameter. The diameter of the rear end can be varied. A cylinder block includes an annular groove, which is coaxial with the support spring. The rear end is elastically deformed in the radial direction and is positioned in the annular groove. This firmly positions the support spring and prevents vibration and noise.

9 Claims, 11 Drawing Sheets

COMPRESSOR AND SPRING POSITIONING STRUCTURE

BACKGROUND OF THE INVENTION

The present invention relates to a coil spring positioner. The present invention also pertains to a compressor for vehicle air-conditioning systems having the spring positioner.

Generally, existing structures for positioning spring ends include an annular groove. A stopper ring is fixed in the annular groove to project inward. One end of a coil spring abuts against the projecting part of the stopper ring, which positions the coil spring.

In a compressor having the above-described structure, as shown in FIG. 12, a crank chamber 203 is formed between a front housing member 201 and a cylinder block 202. In the crank chamber 203, a drive shaft 204 is supported by the front housing member 201 and the cylinder block 202. The cylinder block 202, which constitutes part of the housing, includes a plurality of cylinder bores 202*a*. A piston 206 is accommodated in each cylinder bore 202*a*.

In the crank chamber 203, a swash plate 205, which serves as a drive plate, is supported by the drive shaft 204 to integrally rotate and to incline with respect to the drive shaft. The swash plate 205 is coupled to a lug plate 217 through a hinge mechanism 216, and the lug plate 217 is fixed to the drive shaft 204. Each piston 206 is coupled to the swash plate 205 through a pair of shoes 222. A valve plate 207 is located between the cylinder block 202 and a rear housing member 208.

The rotation of the swash plate 205 is converted into reciprocation of each piston 204 through the corresponding pair of shoes 222. The reciprocation compresses refrigerant gas that is drawn to each cylinder bore 202*a* from a suction chamber 209 through the valve plate 207 and discharges compressed refrigerant gas to a discharge chamber 210.

A bleed passage 224 connects the crank chamber 203 to the discharge chamber 210. A control valve 218 is located in the bleed passage 224 and adjusts the flow rate of refrigerant gas. The difference between the pressure in the crank chamber 203 and the pressure in the cylinder bore 202*a* is varied by the control valve 218. The inclination angle of the swash plate 205 is varied in accordance with the pressure difference, which controls the displacement of the compressor.

The variable displacement compressor of this kind is coupled to an external drive source Eg such as vehicle engines through an electromagnetic clutch 223.

A support spring 212 abuts against the rear end of the drive shaft 204 through a thrust bearing 211. The support spring 212 is a cylindrical coil spring. The support spring 212 urges the drive shaft 204 axially. The support spring 212 prevents chattering of the drive shaft 204 in the axial direction due to measurement error of the parts. The force of the support spring 212 causes the drive shaft 204 to contact the thrust bearing 211.

A center bore 213 is formed substantially in the center of the cylinder block 202. A first annular groove 214 is formed in the center bore 213, and a stopper ring 215 is fitted in the annular groove 214. The support spring 212 engages and is located between the rear surface of a race 211*a* of the thrust bearing 211 and the stopper ring 215. In other words, the rear end 212*a* of the support spring 212 is positioned with respect to the cylinder block 202 by abutting against the stopper ring 215.

A second annular groove 220 is formed in the drive shaft 204 between the swash plate 205 and the cylinder block 202. A stopper ring 221 is fitted in the second annular groove 220. A limit spring 219 engages and is located between the rear surface 205*a* of the swash plate 205 and the stopper ring 221. The limit spring 219 is a cylindrical coil spring. The limit spring 219 resists a force that urges the swash plate 205 toward the rear housing member 202. When the limit spring 219 is compressed to its minimum length, the swash plate 205 is positioned at its minimum inclination angle. The rear end 219*a* of the limit spring 219 is positioned with respect to the drive shaft 204 by the stopper ring 221.

In the prior art spring positioners of FIG. 12, the position of each spring end is determined by a stopper ring. Accordingly, annular grooves for securing the stopper rings are required.

In the compressor of FIG. 12, spaces for the annular grooves 214, 220 for installing the support spring 212, the limit spring 219, and the stopper rings 215, 221 are limited. That is, large spaces are not provided between the race 211*a* and the stopper ring 215 or between the swash plate 205 and the stopper ring 221. To fully meet the force requirements of each spring 212, 219, the springs 212, 219 must be made of wires having a relatively large diameter. However, since the spaces for the springs 212, 219 are relatively small, springs made of relatively small-radius wires are actually used. Therefore, the springs 212, 219 may not have the desired operating characteristics.

A compression load in the direction of the axis of the drive shaft 204 is continually applied to the springs 212, 219. The support spring 212 is supported and compressed between the race 211*a* and the stopper ring 215. The limit spring 219 is supported and compressed between the swash plate and the stopper ring 221. Therefore, radial movement of each spring 212, 219 is limited.

If the compression load is reduced, each spring 212, 219 radially moves as the drive shaft 204 rotates. As a result, each spring 212 repeatedly contacts the inner surface of the center bore 213 and peripheral surface of the drive shaft 204. This generates noise and vibration and wears the springs 212, 219, which shortens the life of the compressor.

SUMMARY OF THE INVENTION

An objective of the present invention is to provide a structure for positioning springs that have enough strength to prevent the noise and vibration of a compressor. Another objective of the present invention is to provide a more durable compressor that includes the spring positioning structure.

To achieve the above objectives, the present invention provides a positioning structure for determining the position of one of two ends of a coil spring relative to a support. The coil spring has a large-diameter end and a small-diameter end. The small-diameter end is opposite to the large-diameter end. Either the large-diameter end or the small-diameter end serves as a positioning end. The support has an annular groove, which is substantially coaxial to the coil spring. The positioning end engages the annular groove, which fixes the position of the positioning end. The positioning end is elastically urged toward the annular groove.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 3(*b*) is an enlarged cross sectional view of the support spring of FIG. 1 when uninstalled;

DETAILED DESCRIPTION OF THE PREFERRED EMBODIMENTS

A single head piston variable displacement compressor according to a first embodiment of the present invention will now be described with reference to FIGS. 1–3.

Figure 2:
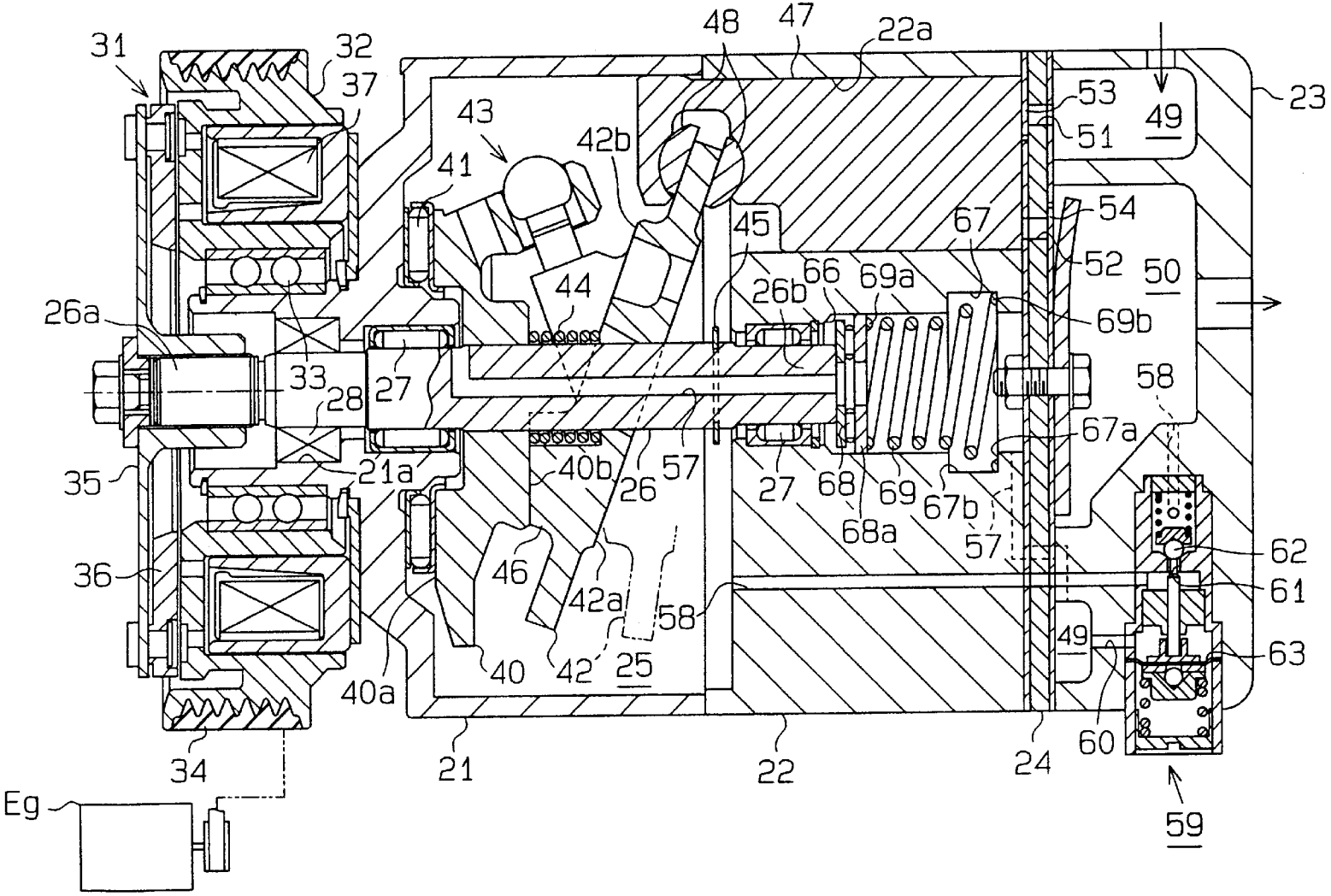
FIG. 2 is a cross sectional view of a compressor having the spring positioning structure of FIG. 1.

As shown in FIG. 2, the front housing member 21 is fixed to the front of a cylinder block 22 . A r ear housing member 23 is fixed to the rear of the cylinder block 22 through a valve plate 24. T he front housing member 21, the cylinder block 22, and the rear housing member 23 constitute the housing of the variable displacement compressor. A crank chamber 25 is formed between the front housing member 21 and the cylinder block 22.

A drive shaft 26 is supported in the front housing member 21 and the cylinder block 22 through a radial bearing 27. The front end 26*a* of the drive shaft 26 projects frontward from the opening 21*a* of the front housing member 21. A lip seal 28 is located between the drive shaft 26 and the inner surface of the opening 21*a* to seal the crank chamber 25.

An electromagnetic clutch 31 is located between an engine Eg and the front end 26*a* of the drive shaft 26. The clutch 31 selectively transmits power from the engine Eg to the drive shaft 26. The clutch 31 includes a rotor 32, a hub 35, and an armature 36. The rotor 32 is supported on the front end of the front housing member 21 by an angular bearing 33. The rotor 32 receives a belt 34. The hub 35 is fixed to the front end 26*a* of the drive shaft 26. The armature 36 is fixed to the hub 35. A coil 37, which is arranged in the rotor 32, is fixed to the front end of the front housing member 21.

A lug plate 40 is fixed to the drive shaft 26 in the crank chamber 25. A front thrust bearing 41 is located between a front surface 41*a* of the lug plate 40 and the inner surface of the front housing member 21. The front thrust bearing 41 receives a thrust load applied to the lug plate 40.

A swash plate 42, which serves as a drive plate, is supported on the drive shaft 26 to slide on and incline with respect to the drive shaft 26. A hinge mechanism 43 is located between the lug plate and the swash plate 42. The swash plate 42 is coupled to the lug plate 40 through the hinge mechanism 43. When the swash plate 42 moves toward the cylinder block 22, the inclination angle of the swash plate 42 decreases. When the swash plate 42 moves toward the lug plate 40, the inclination angle of the swash plate 42 increases.

An inclination reducing spring 44, which is a coil spring, is wound on the drive shaft 26 between the lug plate 40 and the swash plate 42. The inclination reducing spring 44 urges the swash plate 42 toward the cylinder block 22 to reduce the inclination angle of the swash plate 42.

When the rear surface 42*a* of the swash plate 42 abuts against a limit ring 45, which is attached to the drive shaft 26, the inclination of the swash plate 42 is minimized. On the other hand, when a projection 46, which is formed on the front surface 42*b* of the swash plate 42, abuts against the rear surface 40*b* of the lug plate 40, the inclination angle of the swash plate 42 is maximized.

A plurality of cylinder bores 22*a* are formed in the cylinder block 22 about the drive shaft 26 at predetermined intervals. A single head piston 47 is located in each cylinder bore 22*a* and is coupled to the swash plate 42 through a pair of shoes 48. The swash plate 42 converts rotation of the drive shaft 26 into reciprocation of each piston 47.

A suction chamber 49 and a discharge chamber 50 are formed in the rear housing member 23. The valve plate 24 includes suction ports 51, suction valves 52, discharge ports 53 and discharge valves 54, which respectively correspond to each cylinder bore 22*a*. Each suction port 51 connects the suction chamber 49 to the corresponding cylinder bore 22*a*. Each suction valve 53 opens and closes the corresponding suction port 51. Each discharge port 52 connects the discharge chamber 50 to the corresponding cylinder bore 22*a*. Each discharge valve 54 opens and closes the corresponding discharge port 52.

A bleed passage 57 connects the crank chamber 25 to the suction chamber 49. A pressurizing passage 58 connects the discharge passage 50 to the crank chamber 25. A displacement control valve 59 is located in the pressurizing passage 58. The control valve 59, which is a pressure sensitive valve, is connected to the suction chamber 49 through a pressure sensitive passage 60. The control valve 59 includes a valve hole 61, a valve body 62, and a diaphragm 63. The valve hole 61 forms part of the pressurizing passage 58. The valve body 62 opens and closes the valve hole 61. The diaphragm 63 is sensitive to the pressure in the suction chamber 49 (suction pressure Ps), which is admitted through a pressure sensitive passage 60. The valve body 62 is connected to the diaphragm 63. The valve body 62 adjusts the opening size of the valve hole 61 in accordance with the change in the suction pressure Ps.

A center bore 66 is formed substantially in the center of the cylinder block 22 to accommodate the rear end 26*b* of the drive shaft 26. The center bore 66 extends axially through the cylinder block 22. A wide annular groove 67 is formed in the wall of the center bore 66 in the vicinity of the rear end of the center bore 66.

A rear thrust bearing 68 is attached to the rear end 26*b* of the drive shaft 26. A support spring 69, which is a coil spring, engages and is located between a rear race 68*a* of the rear thrust bearing 68 and a rear wall 67*a* of the annular groove 67.

The diameter of the support spring 69 is uniform from the front end 69*a* to the middle portion. The diameter of the support spring 69 from the middle portion to the rear end 69*b* gradually increases. The part of the front end 69*a* contacting the race 68*a* and the part of the rear end 69*b* contacting the rear wall 67*a* of the annular groove 67 are ground to be planar, respectively. The ends of the support spring 69 are not in contact with any other part of the support spring 69 when no force is applied to it.

When a torsion load is applied to the rear end 69*b*, the outer diameter of the rear end 69*b* can decrease according to the torsion load. As shown in FIG. 3(*a*), when the rear end 69*b* of the support spring 69 is accommodated in the annular groove 67, the rear end 69*b* engages the rear wall 67*a* of the annular groove 67, which positions the rear end 69*b* of the support spring 69 with respect to the cylinder block 22.

When the compressor is assembled, the support spring 69 is compressed to produce a predetermined compression force in the direction of the axis of the drive shaft 26. In other words, the support spring 69 is compressed during the installation process. The compression load limits chattering in the axial direction of the drive shaft 26 caused by measurement errors of the parts. Furthermore, the rear thrust bearing 68 contacts the rear end 26*b* of the drive shaft 26. The support spring 69 urges the drive shaft 26 toward the front of the compressor. This ensures that a space exists between the armature 36 and the rotor 32 when the electromagnetic clutch 31 is not operated.

Figure 3:
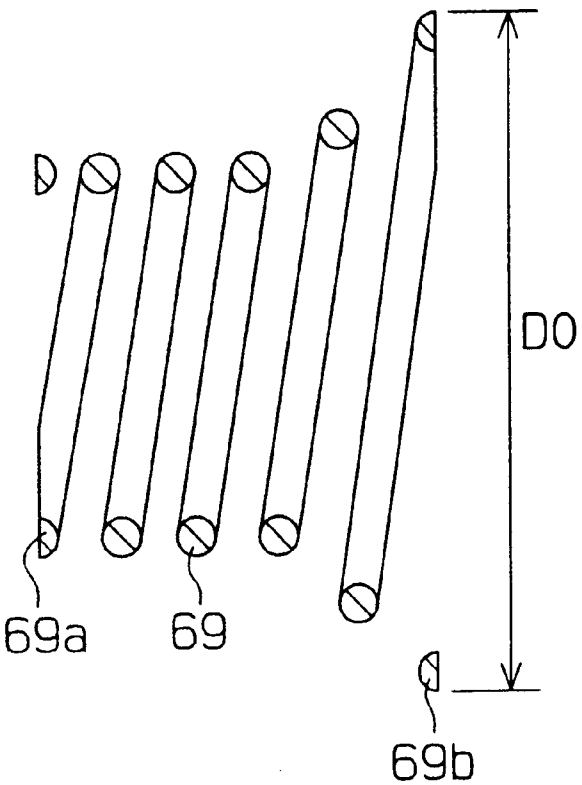
FIG. 3(*a*) is an enlarged cross sectional view of the support spring of FIG. 1.
Figure 3:
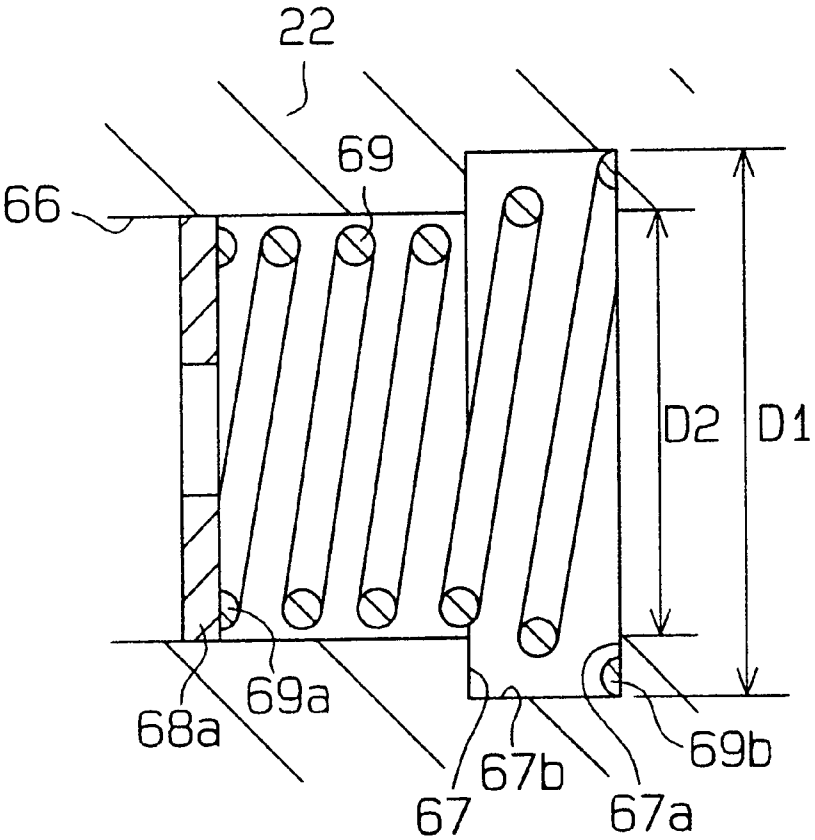

When the support spring 69 is fitted in the annular groove 67 as shown in FIG. 3(*a*), the outer diameter D1 of the rear end 69*b* is smaller than the outer diameter D0 of the rear end 69*b* of the support spring 69 of FIG. 3(*b*) before installation. That is, the rear end 69*b* is radially compressed when the support spring 69 is installed in the annular groove 67. Also, the peripheral surface of the rear end 69*b* of the installed support spring 69 contacts the circumferential wall surface 67*b* of the annular groove 67. This limits radial movement of the support spring 69 and determines the position of the support spring 69 with respect to the cylinder block 22.

Operation of the variable displacement compressor will now be described.

When the engine Eg is started, the coil 37 is excited, the armature 36 is pressed against the rotor 32 against the elastic force of the hub 35, and the clutch 31 is operated, or engaged. When the clutch 31 is engaged, power from the engine Eg is transmitted to the drive shaft 26 through the belt 34 and the clutch 31. On the other hand, when the coil 37 is de-excited, the armature 36 is separated from the rotor 32 by the elastic force of the hub 35, which disengages the clutch 31. In this state, power from the engine Eg is not transmitted to the drive shaft 26.

When power from the engine Eg is transmitted to the drive shaft 26, the drive shaft 26 rotates. The rotation of the drive shaft 26 integrally rotates the swash plate 42 through the lug plate 40. The rotation of the swash plate 42 is converted into reciprocation of each piston 47 through the corresponding pair of shoes 48.

When each piston 47 moves from the top dead center to the bottom dead center, refrigerant gas in the suction chamber 49 is drawn to the corresponding cylinder bore 22*a* via the corresponding suction port 51 through the corresponding suction valve 53. When each piston 47 moves from the bottom dead center to the top dead center, refrigerant gas in the corresponding cylinder bore 22*a* is compressed to reach a predetermined pressure and is discharged to the discharge chamber 50 from the discharge port 52 through the discharge valve 54.

Refrigerant gas in the crank chamber 25 continually flows to the suction chamber 49 at a predetermined flow rate. The displacement control valve 59 controls the supply of refrigerant gas from the discharge chamber 50 to the crank chamber 25 in accordance with the suction pressure Ps. In other words, the control valve 59 controls the opening size of the valve hole 61, which adjusts the pressure Pc in the crank chamber 25. This adjusts the difference between the pressure Pc in the crank chamber 25 applied to the pistons 47 and the pressure in the cylinder bores 22*a* applied to the pistons 47. As a result, the inclination angle of the swash plate 42 is varied, which varies the stroke of each piston 47 and the displacement of the compressor.

When the thermal load on an evaporator in an external refrigerant circuit (not shown) is smaller than a predetermined value, the suction pressure Ps in the suction chamber 49 is lowered. Then, the diaphragm 63 is displaced in accordance with the change of suction pressure Ps. This moves the valve body 62 toward an opened position of the valve hole 61, and refrigerant gas is supplied to the crank chamber 25 from the discharge chamber 50.

When the pressure Pc in the crank chamber 25 increases, the swash plate is moved on the drive shaft 26 toward the cylinder block 22 through the hinge mechanism 43. This positions the swash plate 42 at the minimum inclination angle position, which is shown by the broken line in FIG. 2. As a result, the displacement of the compressor is reduced and the suction pressure Ps is increased.

On the other hand, when the thermal load on the evaporator of the external refrigerant circuit (not shown) is greater than the predetermined value, the suction pressure Ps in the suction chamber 49 increases. This moves the valve body 62 toward a closed position of the valve hole 61 and reduces the supply of refrigerant gas from the discharge chamber 50 to the crank chamber 25. As a result, the pressure Pc in the crank chamber 25 decreases, which increases the inclination angle of the swash plate 42 and the displacement of the compressor.

A method of installing the support spring 69 in the center bore 66 will now be described.

First, a torsion load is applied to the rear end 69*b* of the support spring 69 shown in FIG. 3(*b*) in the winding direction of the spring wire. This makes the outer diameter D0 of the rear end 69*b* smaller than the inner diameter D2 of the cylinder bore 66. In this state, as shown in FIG. 3(*a*) the support spring 69 is placed in the center bore 66 through the rear opening of the center bore 66. The front end 69*a* of the support spring 69 engages the race 68*a* of the rear thrust bearing 68. The rear end 69*b* of the support spring 69 engages the rear wall 67*a* of the annular groove 67. The torsion load applied to the rear end 69*b* is released, and the rear end 69*b* expands radially. As a result, axial and radial positions of the rear end 69*b* are fixed by the engagement of the rear end 69*b* against the rear wall 67*a* and the inner peripheral surface 67*b* of the annular groove 67.

The first embodiment has the following advantages.

The rear end 69*b* of the support spring 69 is accommodated in the annular groove 67 with a torsion load applied. This positions the rear end 69*b* at a predetermined position of the cylinder block 22 without using a stopper ring.

Figure 12:
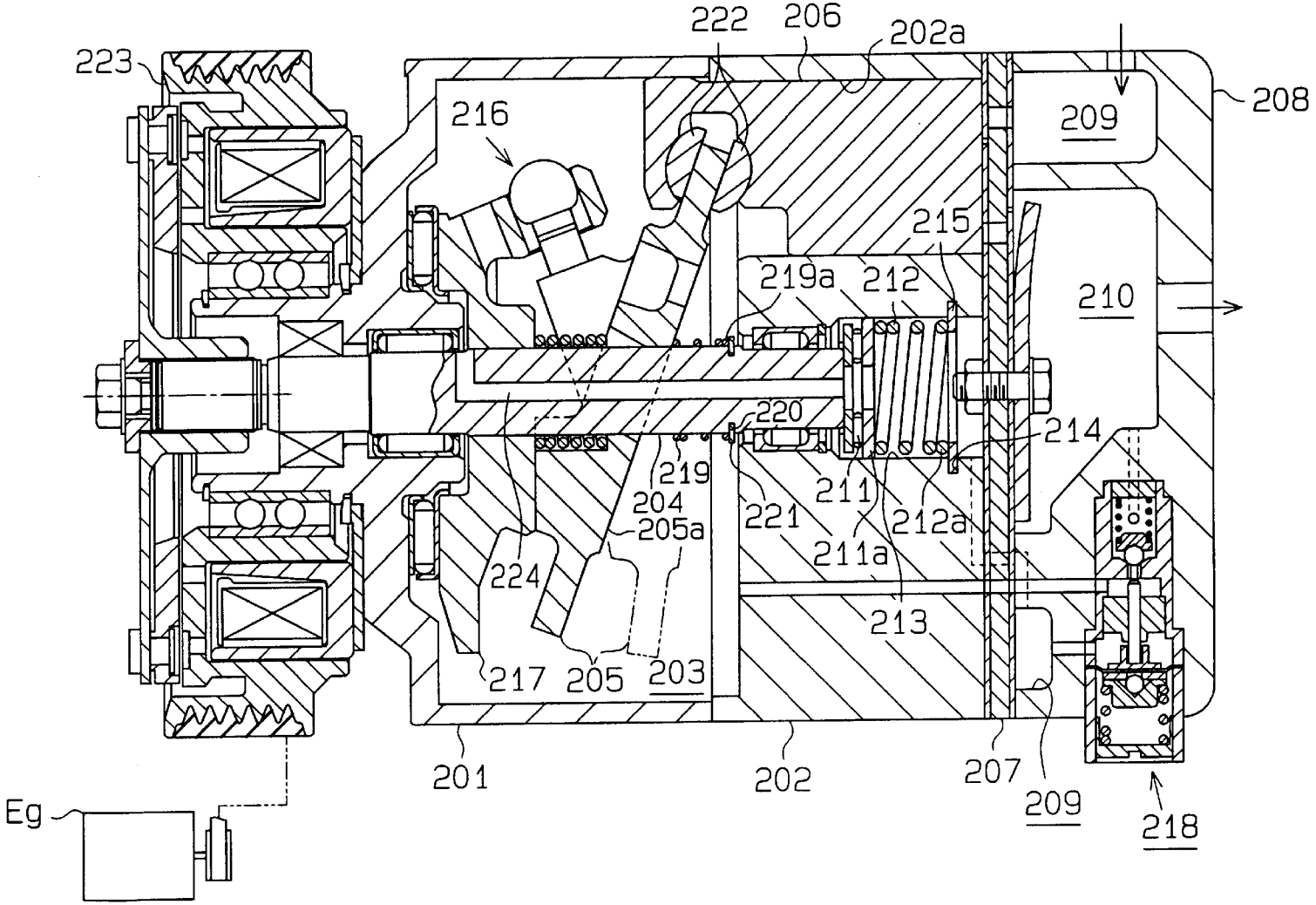
Fig.12 (Prior Art)
FIG. 12 is a cross sectional view of a variable displacement compressor having a prior art spring positioning structure.

Therefore, the installation of the stopper ring 215 of FIG. 12 is omitted. This reduces the number of parts and manufacturing steps, thus reducing the manufacturing cost.

The space available for the support spring 69 is increased by omitting the stopper ring. This enables a more flexible design such as the use of a spring having greater diameter wire, which increases the force of the support spring 69. As a result, vibration and noise of the compressor are reduced.

In the vicinity of the spring 69, the drive shaft 26, the rear thrust bearing 68, and the valve plate are closely arranged. However, since the space for the support spring 69 is increased, there is more flexibility in the design of the support spring 69 and the objects surrounding the rear end 26*b* of the drive shaft 26.

The peripheral surface of the rear end 69*a* of the support spring 69 abuts against the circumferential surface 67*b* of the annular groove 67. Accordingly, the radial movement of the support spring 69 is limited, which limits vibration of the support spring 69 in the radial direction. This prevents the support spring 69 from striking the inner peripheral surface of the center bore 66 and thus prevents the noise and vibration.

In this embodiment, the outer peripheral surface of the support spring 69 is not likely to strike the circumferential surface of the center bore 66, which reduces wear of the circumferential surface of the center bore 22. Also, the generation of wear powder and the associated interference with sliding parts caused by the powder are reduced, which improves the durability of the compressor.

The rear end 69*b* of the support spring 69 is accommodated in the annular groove 67 and the position of the rear end 69*b* of the support spring 69 is thus fixed. Accordingly, the rear end 69*b* of the support spring 69 is easily positioned to a predetermined position.

When the rear end 69 of the support spring 69 is installed in the annular groove 67, the outer diameter D1 of the rear end 69*b* is smaller than the outer diameter D0 before installation. That is, the rear end 69*b* of the support spring 69 is installed in the annular groove 67 while the diameter of the rear end is reduced to a predetermined size.

Therefore, a radially outward force is applied by the rear end 69*b* of the support spring 69. The force caused the outer peripheral surface of the rear end 69*b* of the support spring 69 to be pressed against the circumferential wall 67*b* of the annular groove 67. Accordingly, radial movement of the support spring 69 is limited. As a result, vibration and noise of the compressor from the movement of the support spring 69 is prevented.

Figure 4:
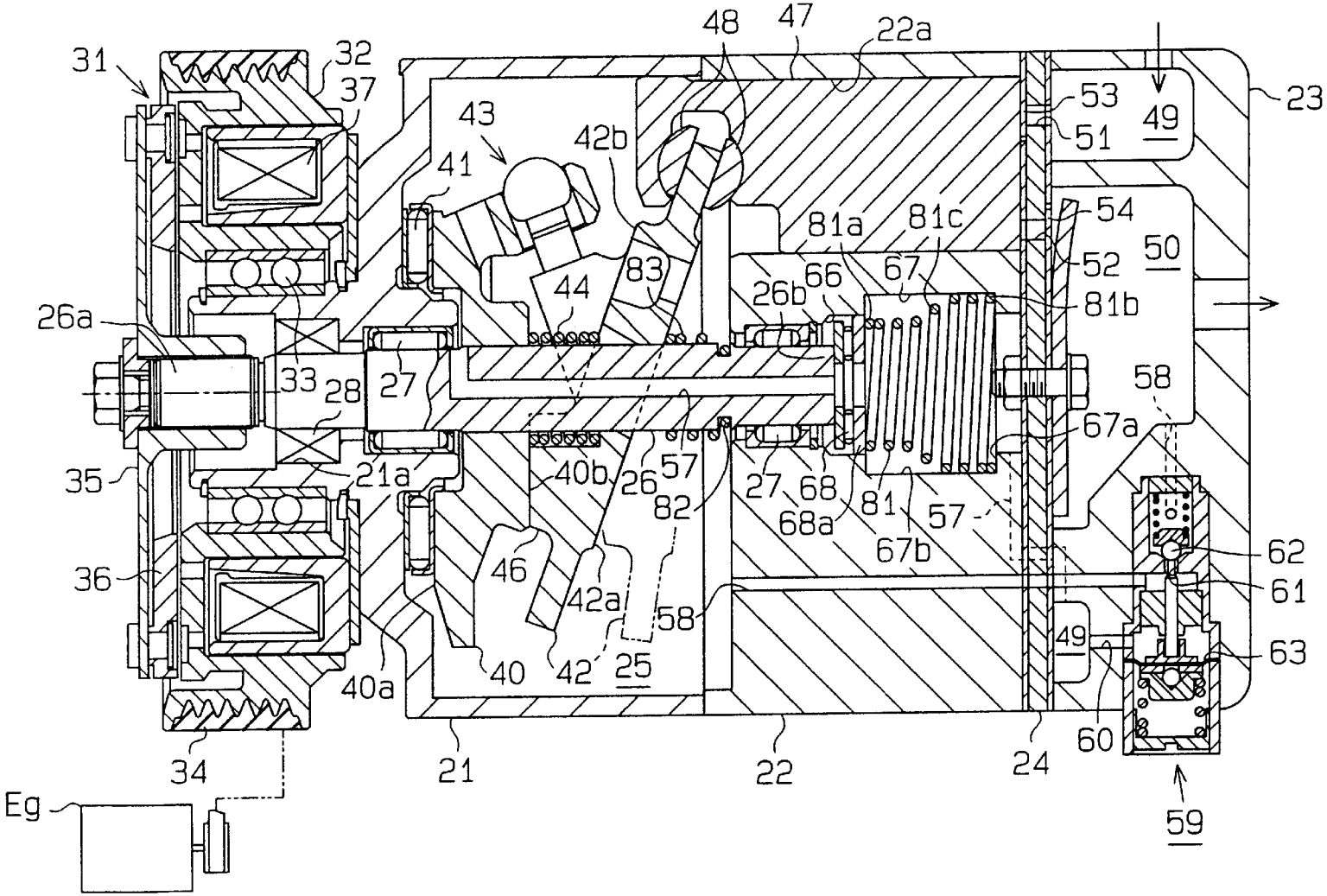
FIG. 4 is a cross sectional view of a variable displacement compressor having a spring positioning structure according to a second embodiment.
Figure 5:
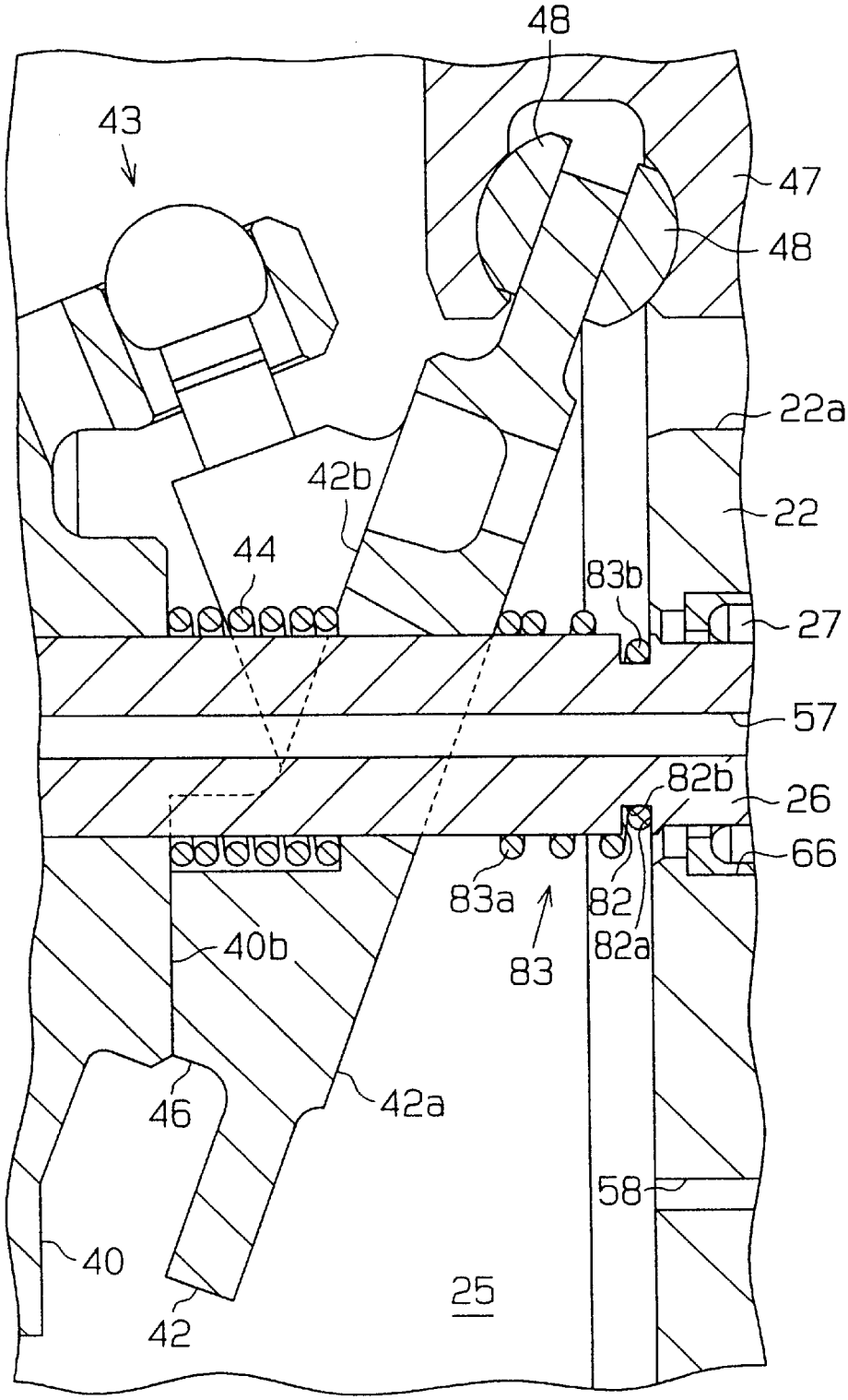
FIG. 5 is a partial enlarged cross sectional view showing the swash plate of FIG. 4.
Figure 6:
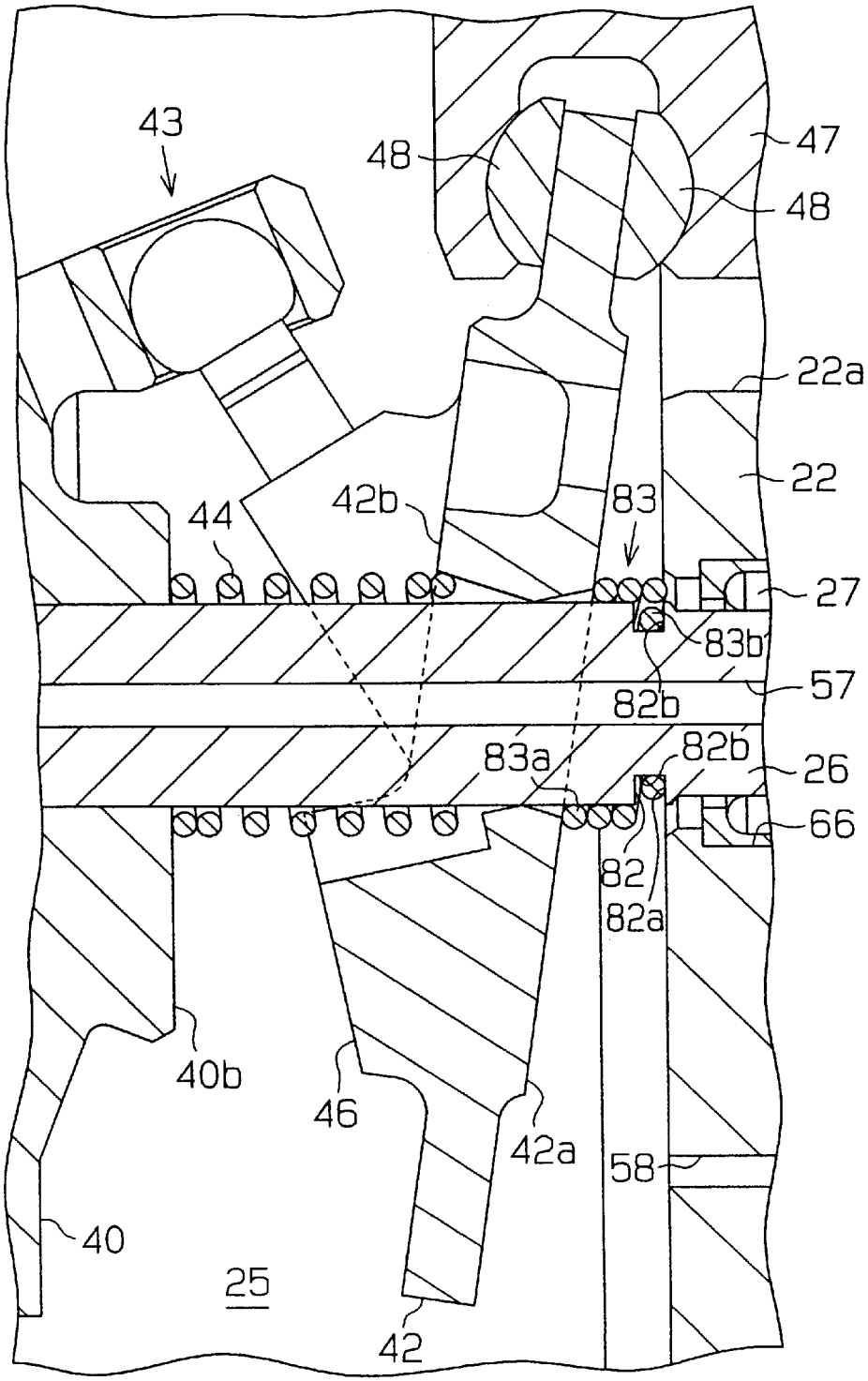
FIG. 6 is a view like FIG. 5 showing the swash plate at its minimum inclination.

FIGS. 4–6 show a spring positioning structure according to a second embodiment of the present invention. The description of the second embodiment is concentrated on the differences from the first embodiment of FIGS. 1–3.

A support spring 81 of FIG. 4, which is a coil spring, includes a front end 81*a*, a rear end 81*b*, and a middle portion 81*c*. The front end 81*a* and the rear end 81*b* are respectively cylindrical with a predetermined diameter. The diameter of the middle portion 81*c* is greater than that of the front end 81*a* and smaller than that of the rear end 81*b*. The front end 81*a* forms a small diameter portion, and the rear end 81*b* forms a large diameter portion. The part of the front end 69*a* contacting the race 68*a* and the part of the rear end 69*b* contacting the rear wall 67*a* are not ground. The ends of the support spring 81 contact the adjacent windings, as shown in FIG. 4.

An annular groove 82 is formed on the outer peripheral surface of the drive shaft 26 in the vicinity of the radial bearing 27. A limit spring 83 is arranged around the drive shaft 26 between the annular groove 82 and the rear surface 42*a* of the swash plate 42

As shown in FIG. 5, the diameter of the limit spring 83 is uniform from the front end 83*a* to the vicinity of the annular groove 82 and is smaller in the vicinity of the rear end 83*b*. The front end 83*a* forms a large diameter portion, and the rear end 83*b* forms a small diameter portion. The part of the front end 83*a* contacting the rear wall 42*a* of the swash plate 42 and the part of the rear end 83*b* contacting the rear wall 82*a* of the annular groove 82 are not ground. The ends of the limit spring contact the adjacent windings of the limit spring 83.

When a torsion load is applied to the rear end 83*b*, the rear end 83*b* elastically deforms to expand radially. The rear end 83*b* of the limit spring 83, which is accommodated in the annular groove 82, engages the rear wall 82*a* and the inner peripheral surface 82*b* of the annular groove 82. This limits the movement of the rear end 83*b* of the limit spring 83 in the axial and radial directions with respect to the drive shaft 26. As a result, the rear end 83*b* of the limit spring 83 is positioned with respect to the drive shaft 26.

When the pressure Pc in the crank chamber 25 is increased as in FIG. 2, the swash plate 42 moves toward the cylinder block 22 against the force of the limit spring 83. The movement gradually compresses the limit spring 83. When the limit spring 83 is compressed to its minimum size, the swash plate 42 is positioned at the minimum inclination angle (See FIG. 6).

The installation of the limit spring 83 will now be described with reference to FIGS. 5 and 6.

Before installation, the diameter of the rear end 83*b* of the limit spring 83 is smaller than the diameter of the drive shaft 26. A torsion load in a direction opposite to the winding direction of the limit spring 83 is applied to the rear end 83*b*. The torsion load makes the diameter of the rear end 83*b* greater than the diameter of the drive shaft 26. In this state, the drive shaft 26 passes through the limit spring 83 through one opening of the limit spring 83. Then, the front end 83*a* abuts against the rear surface 42*a* of the swash plate 42, and the rear end 83*b* abuts against the rear wall 82*a* of the annular groove 82. Next, the torsion load applied to the rear end 83*b* is released, and the rear end 83*b* engages the annular groove 82. As a result, the rear end 83*b* of the limit spring 83 abuts against the rear wall 82*a* of the annular groove 82, and the axial position of the rear end 83*b* is thus fixed.

Figure 1:
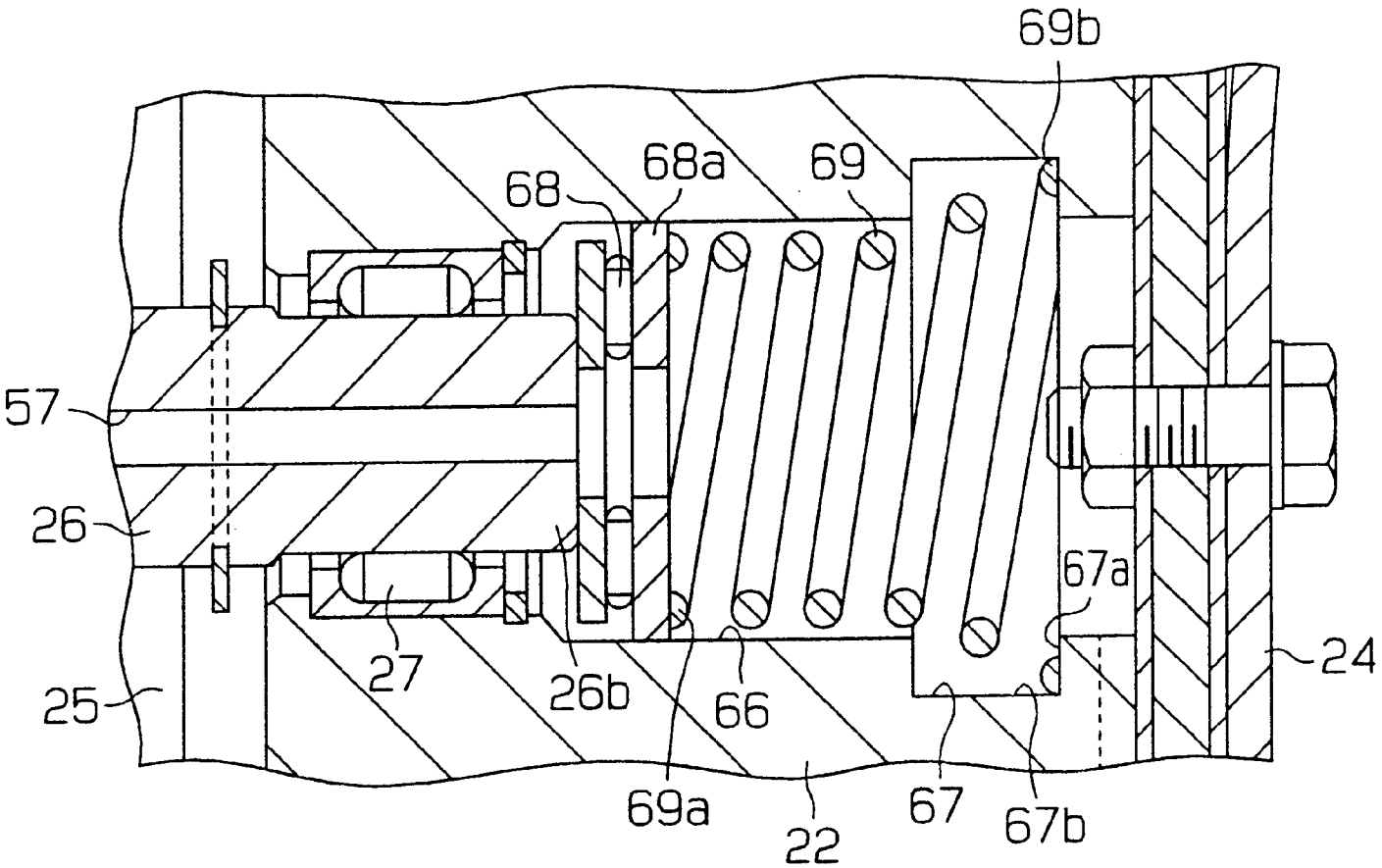
FIG. 1 is a cross sectional view of a spring positioning structure according to a first embodiment of the present invention.

The second embodiment has the following advantages in addition to the advantages of the first embodiment of FIGS. 1–3.

Before the drive shaft 26 passes through the limit spring 83, a torsion force is applied to the rear end 83*b* of the limit spring 83 to expand the rear end 83*b*. Then the torsion load is released and the rear end 83*b* of the limit spring 83 is fitted in the annular groove 82.

Accordingly, the rear end 83*b* is easily positioned at a predetermined position on the drive shaft 26 without a stopper ring.

The radial movement of the installed limit spring 83 is limited since the inner surface of the rear end 83*b* contacts the inner surface 82*b* of the annular groove 82. This prevents the inner surface of the limit spring 83 from striking the outer surface of the drive shaft 26 and thus prevents noise and vibration. Also, since wear powder is not produced, friction is reduced.

A third embodiment of the present invention will now be described with reference to FIGS. 7–9. The present invention is embodied in a clutchless single head piston compressor, which is connected to the engine Eg without an electromagnetic clutch, and a structure for positioning an opener spring urging a shutter that opens and closes a suction passage. The description of the third embodiment is concentrated on the differences from the first embodiment of FIGS. 1–3.

Figure 7:
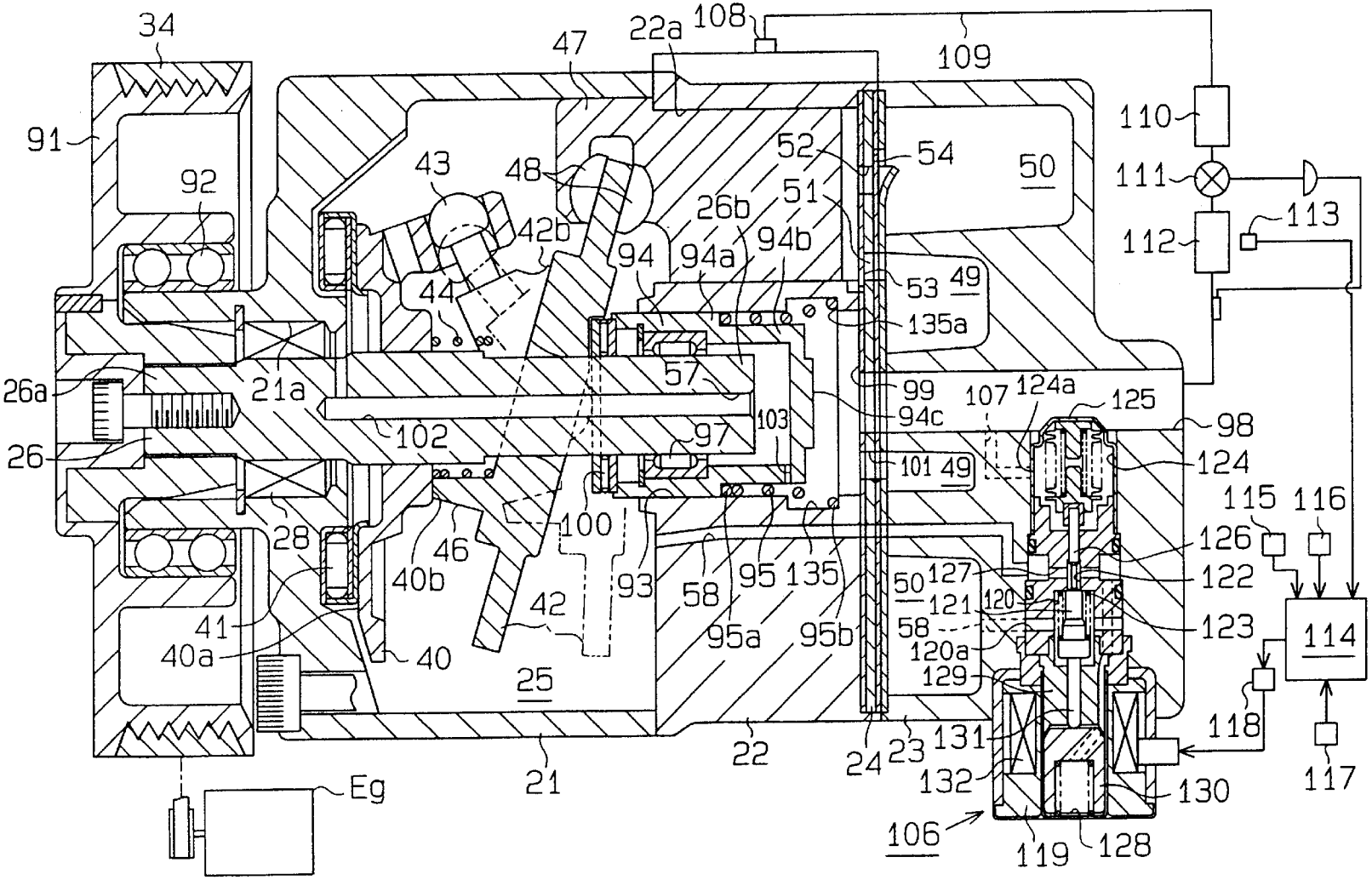
FIG. 7 is a cross sectional view of a clutchless variable displacement compressor having a spring positioning structure according to a third embodiment.

As shown in FIG. 7, a rotor 91 is fixed to a front end 26*a* of the drive shaft 26. The rotor 91 is coupled to the engine Eg through a belt 34. The rotor 91 is supported by a front housing member 21 through an angular bearing 92. The front housing member 21 receives an axial load and a redial load, which are applied to the rotor 91, through the angular bearing 92.

A center bore 93 is formed substantially in the center of a cylinder block 22 to extend in the axial direction of the drive shaft 26. A cylindrical shutter 94 having one end closed is fitted in the center bore 93. The shutter 94 can slide axially within the center bore 93. The shutter 94 includes a large diameter portion 94*a* and a small diameter portion 94*b*. An opener spring 95 urges the shutter 94 toward a swash plate 42.

The rear end 26*b* of the drive shaft 26 is inserted in the shutter 94. A radial bearing 97, which is fixed to the inner peripheral surface of the shutter 94, supports the drive shaft 26. The radial bearing 97 can move axially on the drive shaft 26 with the shutter 94.

A suction passage 98 is formed substantially in the center of the rear housing member 23 and the valve plate 24 to extend in the axial direction of the drive shaft 26. The suction passage 98 is connected to the center bore 93. A positioning surface 99 is formed about the opening of the suction passage 98. The small diameter portion 94*b* of the shutter 94 includes a shutting surface 94*c*, which can contact the positioning surface 99. When the shutting surface 94*b* contacts the positioning surface 99, the suction passage 98 is disconnected from the center bore 93.

A thrust bearing 100 is supported on the drive shaft 26 between the swash plate 42 and the shutter 94 to slide on the drive shaft 26. The thrust bearing 100 is sandwiched between the swash plate 42 and the end surface of the large diameter portion 94*a* of the shutter 94 by the force of the opener spring 95.

As the inclination of the swash plate 42 decreases, the swash plate 42 moves toward the shutter 94. During this movement, the swash plate 42 pushes the shutter 94 through the thrust bearing 100. Accordingly, the shutter 94 moves toward the positioning surface 99 against the force of the opener spring 95. When the shutting surface 94*c* of the shutter 94 contacts the positioning surface 99, the swash plate 42 is positioned at its minimum inclination angle.

The suction chamber 49 is connected to the center bore 93 through a communication passage 101, which is formed in the valve plate 24. When the shutter 94 contacts the positioning surface 99, the communication passage 101 is disconnected from the suction passage 98. An axial passage 102 is formed in the drive shaft 26. The axial passage 102 connects the crank chamber 25 to the internal space of the shutter 94. A pressure release passage 103 is formed in the peripheral wall of the shutter 94. The internal space of the shutter 94 is connected to the center bore 93 through the pressure release passage 103.

The pressurizing passage 58 connects a discharge chamber 50 to the crank chamber 25. A displacement control valve 106 is located in the pressurizing passage 58 to selectively open and close the pressurizing passage 58. A pressure detection passage 107 is formed between the suction passage 98 and the control valve 106 to apply the suction pressure Ps to the control valve 106.

A discharge port 108 discharges refrigerant gas from the discharge chamber 50. An external refrigerant circuit 109 connects the suction passage 98 to the discharge chamber 50 through the discharge port 108. The external refrigerant circuit 109 includes a condenser 110, an expansion valve 111 and an evaporator 112. A temperature sensor 113 is located in the vicinity of the evaporator 112. The temperature sensor 113 detects the temperature of the evaporator 113 and outputs the detection signal to a computer 114. The temperature of the evaporator 112 reflects the thermal load applied on the refrigeration circuit. The computer 114 is connected to a passenger compartment temperature sensor 116 and an air-conditioner switch 117.

The computer 114 instructs a drive circuit 118, based on the passenger compartment temperature set by a temperature adjuster 115, the detection temperatures from the passenger compartment temperature sensor 116 and the temperature sensor 113, and an ON/OFF signal of the air-conditioner switch 117. The drive circuit 118 outputs a current to a solenoid 119 of the control valve 106. The level of the current is determined by the instructions form the computer 114. Other external signals include signals from an external temperature sensor and an engine speed sensor. Therefore, the current supply value is determined in accordance with the current conditions of the vehicle.

A valve chamber 120 is defined in the center of the control valve 106. A valve body 121 is accommodated in the valve chamber 120 to face a valve hole 122 connected to the valve chamber 120. An opener spring 123 urges the valve body 121 toward an opened position of the valve hole 122. The valve chamber 120 is connected to the discharge chamber 50 in the rear housing member 23 through a valve chamber port 120*a* and the pressurizing passage 58.

A pressure sensitive chamber 124 is defined in the upper portion of the control valve 106. The pressure sensitive chamber 124 is connected to the suction passage 98 through a pressure sensitive port 124*a* and the detection passage 107. A bellows 125 is accommodated in the pressure sensitive chamber 124 to operate in accordance with the suction pressure Ps of the suction passage 98. The bellows 125 is detachably coupled to the valve body 121 through a pressure sensitive rod 126.

A port 127 is provided between the valve chamber 120 and the pressure sensitive chamber 124 and is perpendicular to the valve hole 122. The valve hole 122 is open in the middle portion of the port 127. The port 127 is connected to the crank chamber 25 through the pressurizing passage 58.

The solenoid 119 is located in the lower portion of the control valve 106. A plunger chamber 128 is defined in the solenoid 119. A fixed iron core 129 is fitted in the upper opening of the plunger chamber 128. A movable iron core 130, which is shaped like a cup, is accommodated in the plunger chamber 128 to reciprocate. The movable core 130 is coupled to the valve body 121 through the pressure sensitive rod 131.

A cylindrical coil 132 is arranged around the fixed core 129 and the movable core 130. The computer 114 instructs the drive circuit 118 to supply a predetermined value of electric current to the coil 132.

The third embodiment has the following characteristics.

The wide annular groove 135 is formed in the vicinity of the rear end of the center bore 93. The opener spring 95, which is a coil spring, engages and is located between the rear wall 135*a* of the annular groove 135 and the step between the large diameter portion 94*a* and the small diameter portion 94*b* of the shutter 94.

The wire of the opener spring 95 is wound to have a uniform diameter from the front end 95*a* to the middle portion. The diameter of the opener spring 95 gradually increases from the middle portion toward the rear end 95*b*. The front end 95*a* forms the small diameter portion, and the rear end 95*b* forms the large diameter portion. When a torsion load is applied to the rear end 95*b*, the outer diameter of the rear end 95*b* decreases accordingly. When the rear end 95*b* is fitted in the annular groove 135, the rear end 95*b* abuts against the rear wall 135*a* of the annular groove 135. The abutment positions the rear end 95*b* of the opener spring 95 with respect to the cylinder block 22.

Operation of the illustrated compressor will now be described.

When the air-conditioner switch is on and the detection signal of the passenger compartment temperature sensor 115 is equal to or greater than the set value, the computer 114 excites the solenoid 119. Then, a predetermined electric current is supplied to the coil 132 through the drive circuit 118, which generates attraction force between the cores 129, 130 in accordance with the current supply. The attraction force reduces the opening size of the valve hole 122 against the force of the opener spring 123.

When the solenoid 119 is excited, the bellows 125 move axially in accordance with the suction pressure Ps, which is applied from the suction passage 98 to the pressure sensitive chamber 124 through the pressure detection passage 107. The displacement of the bellows 125 is transmitted to the valve body 121 through the pressure sensitive rod 126. Accordingly, the opening size of the valve hole 122 is adjusted by the balance between the force from the bellows 125 and the force from the opener spring 123.

When the thermal load on the evaporator 112 of the external refrigerant circuit 109 is great, the difference between the detected temperature of the passenger compartment temperature sensor 116 and the target temperature set by the temperature adjuster 115 increases. The computer 114 instructs the drive circuit 118 to increase the supply of electric current to the solenoid 119 when the detected temperature is higher. This increases the attraction force between the fixed core 129 and the movable core 130, which urges the valve body 121 toward the closed position of the valve hole 122. The increase of the electric current supply causes the control valve 106 to maintain a lower suction pressure Ps.

As the opening size of the valve hole 122 is reduced, the supply of refrigerant gas from the discharge chamber 50 to the crank chamber 25 through the pressurizing passage 58 is reduced. On the other hand, refrigerant gas in the crank chamber 25 flows to the suction chamber 49 through the bleed passage 57, which includes the axial passage 102, the internal space of the shutter 94, the pressure release passage 103, the center bore 94, and the communication passage 101. Therefore, the pressure Pc in the crank chamber 25 decreases. Accordingly, the difference between the pressure Pc in the crank chamber 25 and the pressures in the cylinder bores 22*a* is reduced, which increases the inclination of the swash plate 42 and the displacement of the compressor.

When the valve hole is completely closed by the valve body 121, the supply of refrigerant gas from the discharge chamber 50 to the crank chamber 25 is stopped. Then, the pressure Pc in the crank chamber 25 becomes substantially equal to the suction pressure Ps, which maximizes the inclination of the swash plate 42 and the displacement of the compressor.

When the thermal load on the evaporator 112 is small, the difference between the detected temperature from the passenger compartment temperature sensor 116 and the target temperature set by the temperature adjuster 115 is reduced. When the difference is smaller, the computer 114 instructs the drive circuit 118 to reduce the supply of electric current to the coil 132. This decreases the attraction force between the fixed core 129 and the movable core 130, which decreases the force that urges the valve body 121 toward the closed position of the valve hole 122. The valve body 121 changes the opening size of the valve hole to maintain a higher suction pressure Ps. Accordingly, the decrease of the supply of electric current causes the control valve 106 to maintain the higher suction pressure Ps (a target value of the suction pressure).

As the opening size of the valve hole increases, the supply of refrigerant gas from the discharge chamber 50 to the crank chamber 25 increases. As a result, the pressure Pc in the crank chamber 25 increases. Also, when the thermal load is small, the pressure Ps in the suction chamber 49 decreases, which increases the difference between the pressure Pc in the crank chamber 25 and the pressures in the cylinder bores 22*a*. This reduces the inclination of the swash plate 42 and the displacement of the compressor.

When there is substantially no thermal load on the evaporator 112, the temperature in the evaporator 112 becomes low enough to generate frost. When the detection temperature from the temperature sensor 113 is equal to or below a predetermined temperature, the computer 114 instructs the drive circuit 118 to de-excite the solenoid 119. The predetermined temperature corresponds to a temperature at which frost is generated. When the solenoid 119 is deexcited, or the supply of electric current to the coil 132 is stopped, there is no longer any attraction force between the fixed core 129 and the movable core 130.

Figure 9:
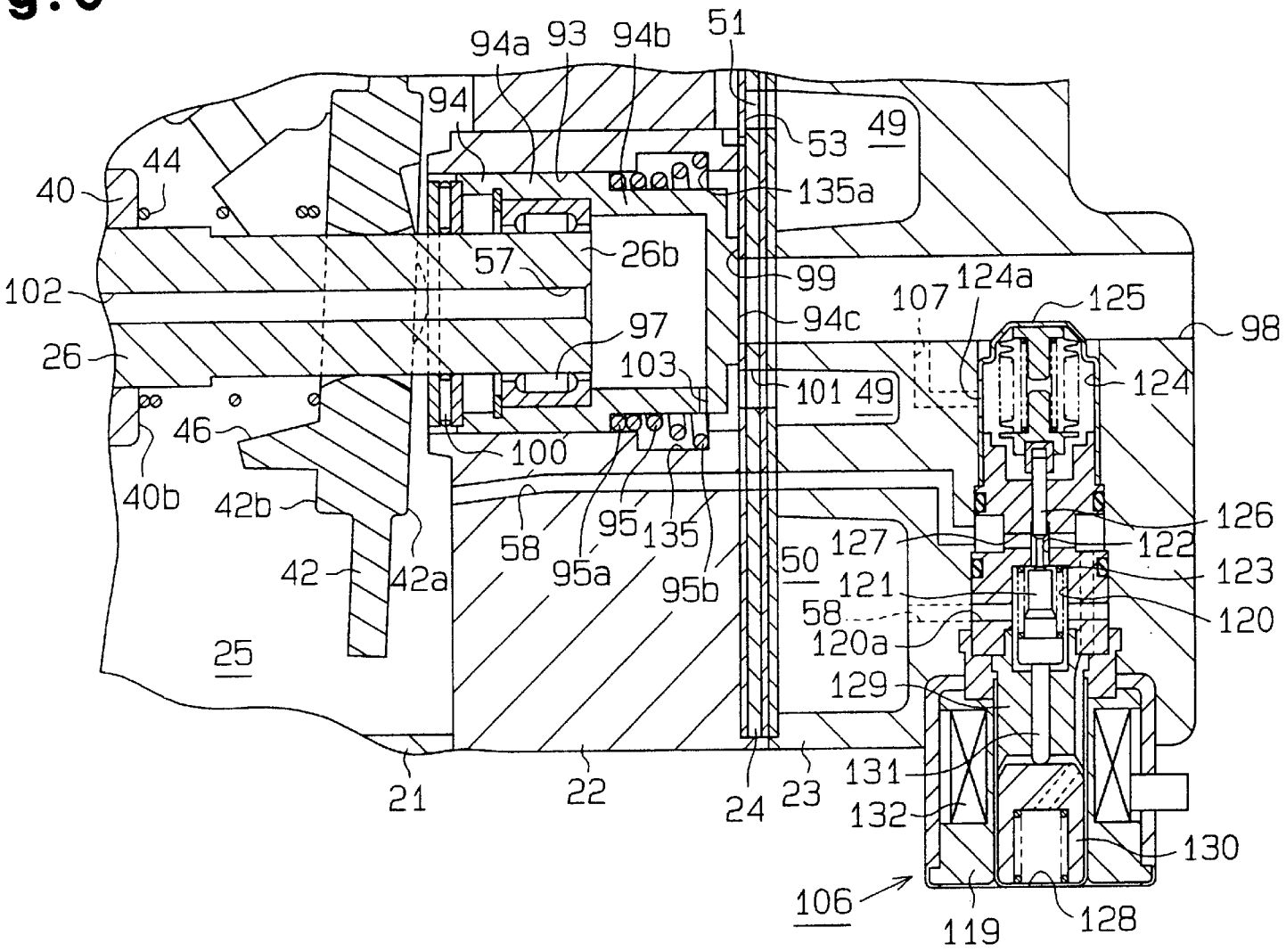
FIG. 9 is a view like FIG. 8 showing the swash plate at the minimum inclination.

Therefore, as shown in FIG. 9, the opener spring 123 urges the valve body 121 toward the solenoid 119 to maximize the opening size of the valve hole 122. As a result, refrigerant gas is supplied from the discharge chamber 50 to the crank chamber 25 through the pressurizing passage 58, which increases the pressure Pc in the crank chamber 25. This minimizes the inclination of the swash plate 42 and the displacement of the compressor.

The computer 114 de-excites the solenoid 119 based on the OFF signal of the air-conditioner switch 117. The de-excitation also minimizes the inclination of the swash plate 42.

As described, the control valve 106 varies the target value of the suction pressure Ps in accordance with the electric current applied to the coil 32. Also, the control valve 106 can operate the compressor at a minimum displacement regardless of the suction pressure Ps. The compressor controls the inclination angle of the swash plate 42 to maintain the suction pressure at the target value and adjusts the displacement.

The control valve 106 enables the compressor to vary the cooling capacity of the external refrigerant circuit 109.

As shown in FIG. 9, when the inclination of the swash plate 42 is minimized, the shutter 94 abuts against the positioning surface 99 and closes the suction passage 98. In this state, the flow of refrigerant gas from the external refrigerant circuit 109 to the suction chamber 49 is prevented. The minimum inclination angle of the swash plate 42 is slightly greater than zero degrees. When the shutter 94 closes the suction passage 98, the swash plate 42 is positioned at minimum inclination angle. The shutter 94 moves between the minimum inclination position and the maximum inclination position of the swash plate 42.

Since the minimum inclination angle of the swash plate 42 is not zero degrees, the supply of refrigerant gas from the cylinder bores 22*a* to the discharge chamber 50 is continued. Refrigerant gas supplied from the cylinder bores 22*a* to the discharge chamber 50 flows to the crank chamber 25 through the pressurizing passage 58. Refrigerant gas in the crank chamber 25 flows to the suction chamber 49. Refrigerant gas in the suction chamber 49 is supplied to the cylinder bores 22*a* and flows again to the discharge chamber 50.

When the inclination angle of the swash plate 42 is minimized, refrigerant gas circulates through the discharge chamber 50, the pressurizing passage 58, the crank chamber 25, the bleed passage 57, the suction passage 49, and the cylinder bores 22*a*. Lubricant oil in the refrigerant gas lubricates each part of the compressor during the circulation.

When the air-conditioner switch is turned on, the inclination angle of the swash plate 42 is minimized, and if the thermal load increases due to an increase of the passenger compartment temperature, the detection temperature from the passenger compartment temperature sensor 116 exceeds a target temperature set by the temperature adjuster 115. The computer 114 excites the solenoid 119 based on the detection temperature. The pressure Pc in the crank chamber 25 is lowered by the release of pressure to the suction chamber 49 through the bleed passage 57. The decrease of pressure expands the opener spring of FIG. 9. As a result, the shutter 94 is separated from the positioning surface 99, which increases the inclination of the swash plate.

As the shutter 94 separates from the positioning surface 99, the suction passage 98 is gradually opened and refrigerant gas flows from the suction passage 98 to the suction chamber 49. Accordingly, the supply of refrigerant gas from the suction chamber 49 to the cylinder bores 22*a* is gradually increased and the displacement of the compressor is gradually increased. Therefore, the discharge pressure Pd gradually increases and the torque of the compressor does not greatly fluctuate in a sudden manner. As a result, the fluctuation of the torque between minimum displacement and maximum displacement is mitigated.

When the engine Eg is stopped, the operation of the compressor is stopped, and the control valve 58 stops the supply of electric current to the coil 132. Therefore, the solenoid 119 is de-excited and the pressurizing passage 58 is opened, which minimizes the inclination of the swash plate 42. The pressure in the compressor is equalized if the compressor is stopped for some time. When the compressor is not operated, the inclination of the swash plate 42 is minimized by an inclination reducing spring 44. When the operation of the compressor is started by starting the engine Eg, the swash plate 42 is initially driven at its minimum inclination state, which prevents torque shock when starting the compressor.

Accordingly, the third embodiment has the following advantages in addition to the first embodiment of FIGS. 1–3.

The rear end 95*b* of the opener spring 95 is positioned in the annular groove 135 of the center bore 93. Therefore, the rear end 95*b* of the opener spring 95 can be positioned without a projection such as a stopper ring projecting from the inner surface of the center bore.

Therefore, the shutter 94 and the thrust bearing 100 can be replaced with a shutter having a different length and a thrust bearing having a different thickness without disassembling the front side of the cylinder block 22. That is, the rear side of the cylinder block 22 is opened, the rear end 95*b* of the opener spring 95 is radially compressed and detached by applying a torsion force, and this enables the replacement of the shutter 94 and the thrust bearing 100.

The present invention is not limited to the above embodiments but may be varied as follows.

Figure 10:
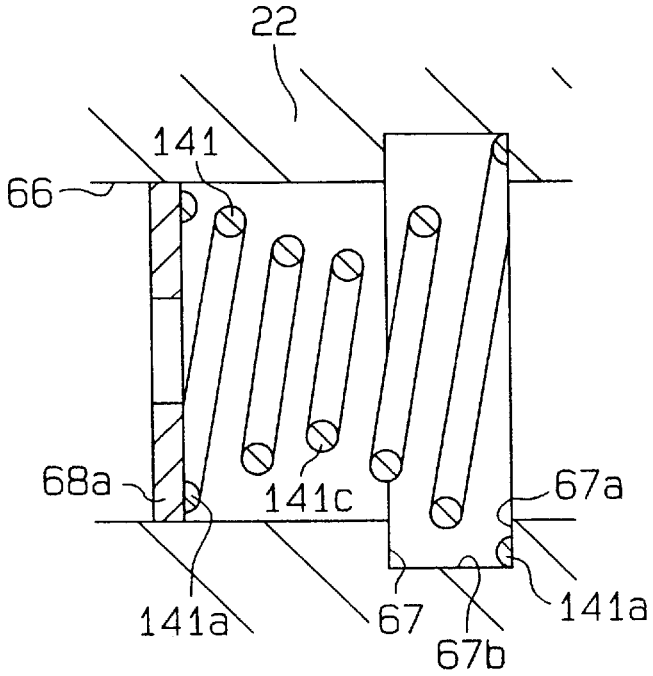
FIG. 10 is an enlarged cross sectional view of a spring positioning structure according to a fourth embodiment.

The diameter of the support spring 69 of FIG. 1 and the support spring 81 of FIG. 5 may be varied like the support spring 141 of FIG. 10. As shown in FIG. 10, the support spring 141 is formed such that the outer diameter gradually decreases from a front end 141*a* to a middle portion 141*c* and gradually increases from a middle portion 141*c* to a rear end 141*b*. This structure has the same advantages of the other embodiments.

Figure 11:
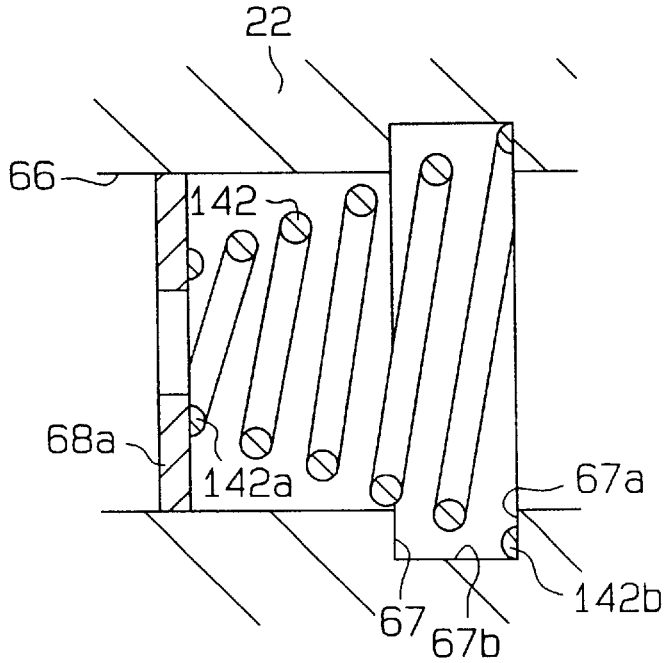
FIG. 11 is an enlarged cross sectional view of a spring positioning structure according to a fifth embodiment.

As shown in FIG. 11, the support springs 69, 81 and the opener spring 95 may be varied like the support spring or opener spring 142. The spring 142 may be formed such that the outer diameter gradually increases from the front end 142*a* to the rear end 142*b*.

An annular groove may be formed on the drive shaft 26 in the vicinity of the lug plate 40. The front end of the inclination reducing spring 44 may be positioned in the annular groove. The front end of the inclination reducing spring 44 is a small diameter portion that can be elastically expanded in the radial direction.

In this structure, the distance between the front surface 42*b* of the swash plate 42 the rear surface 40*b* of the lug plate 40 is relatively long in the vicinity of the drive shaft 26. This structure is effective especially when it is difficult to cause the front end of the inclination reducing spring 44 to abut against the rear surface 40*b* of the lug plate 40. That is, the front end of the inclination reducing spring 44 can be positioned without using a stopper ring, which reduces the number of parts and manufacturing steps.

The positioning structure of the rear end 69*b* of the support spring 69 of FIGS. 1–3, the rear end 81*b* of the support spring 81 of FIGS. 4–6, or the rear end 95*b* of the opener spring 95 of FIGS. 7–9 may be employed in a variable displacement compressor as follows. The pressure Pc in the crank chamber 25 is varied by adjusting the flow rate of refrigerant gas from the crank chamber 25 to the suction chamber 49 through the control valve located in the bleed passage 57. The inclination angle of the swash plate 42 is varied by varying the difference between the pressure Pc in the crank chamber 25 and the pressure in each cylinder bore 22*a*, which varies the stroke of each piston 47 and the displacement of the compressor.

The positioning structure of the rear end 69*b* of the support spring 69 and the rear end 81*b* of the support spring 81 may be employed in other types of compressors such as single head piston or double head piston fixed displacement compressors, compressors using a wave type drive plate instead of a swash plate, or wobble type compressors.

Figure 8:
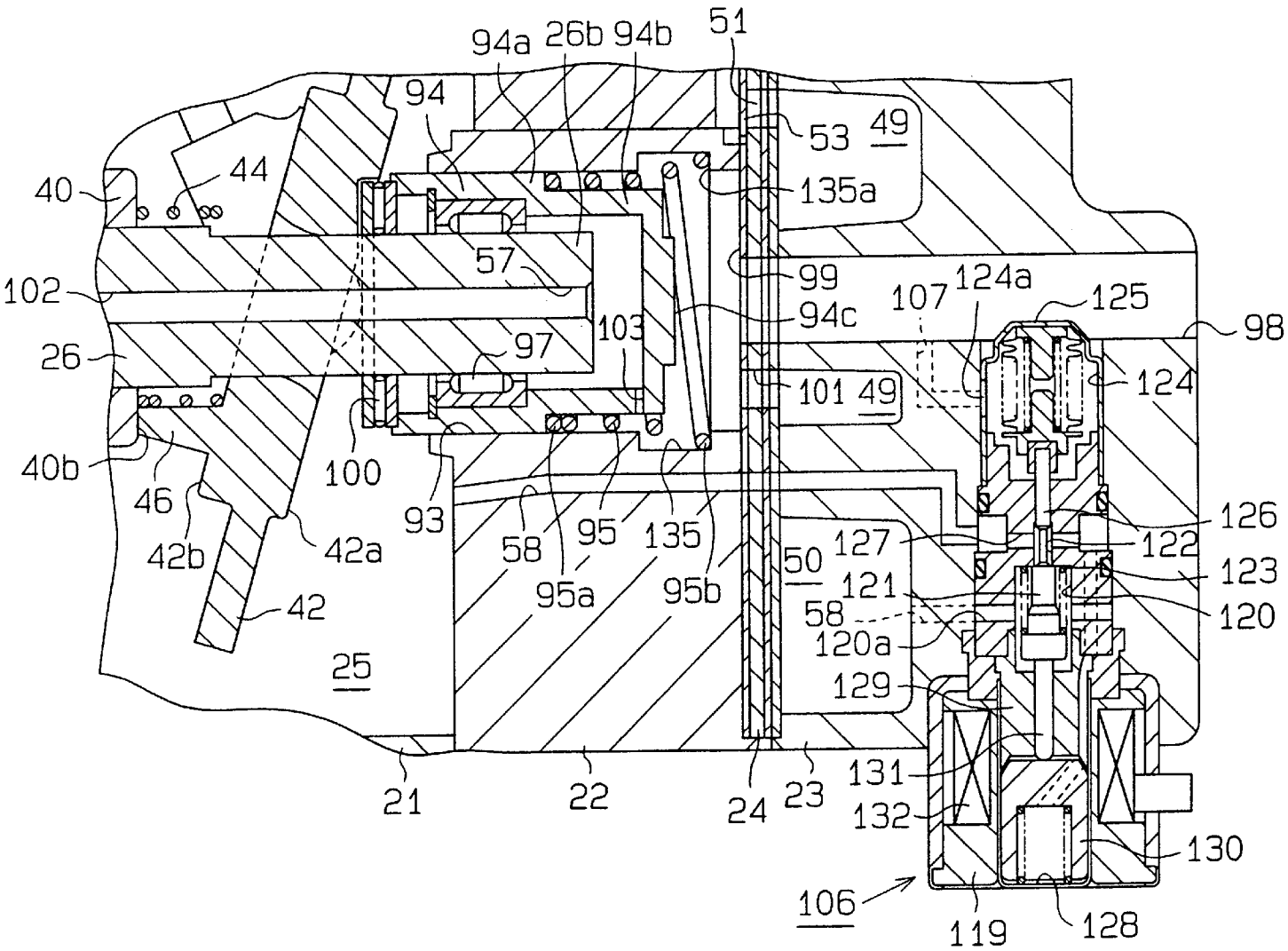
FIG. 8 is a partial enlarged cross sectional view showing the swash plate of FIG. 7 positioned at the maximum inclination angle.

In the third embodiment of FIGS. 7–9, the front end of the drive shaft 26 may be coupled to the electromagnetic clutch 31 of FIG. 2. The drive shaft 26 may be intermittently coupled to the engine Eg through the electromagnetic clutch 31.

In this structure, the electromagnetic clutch 31 can be disengaged only when the air-conditioner switch 117 is turned off, and, when the air-conditioner switch 117 is turned on, the operation is the same as that of a clutchless variable displacement compressor. As a result, the operation of the clutch 31 is smooth and this improves the performance of the vehicle.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claim is:

1. A compressor comprising:

a housing defining a crank chamber;

a drive shaft, which is supported in the housing and which passes through the crank chamber;

a drive plate located in the crank chamber;

a piston connected to the drive plate, wherein the piston is reciprocated by movement of the drive plate;

a coil spring located at one end of the drive shaft, wherein the coil spring has a large-diameter end and a small-diameter end, the small-diameter end being opposite to the large-diameter end, wherein either the large-diameter end or the small-diameter end, serves as a positioning end that is fixed relative to the housing, wherein the housing has an annular groove, which is substantially coaxial to the coil spring, wherein the positioning end engages the annular groove, and wherein the positioning end is elastically urged toward the annular groove, which fixes the position of the positioning end.

2. The positioning structure according to claim 1, wherein the annular groove has a circumferential surface that is coaxial to the coil spring, wherein the positioning end is elastically urged against the circumferential surface of the annular groove in the radial direction of the coil spring.

3. The positioning structure according to claim 1, wherein the housing includes a bore, which accommodates the coil spring, wherein the annular groove is formed in the wall of the bore, wherein the diameter of the positioning end is constructed during installation so that the positioning end fits in the annular groove.

4. The compressor according to claim 1, wherein the positioning end is constricted in the radial direction by the housing.

5. A compressor comprising:

a housing defining a crank chamber;

a drive shaft, which is supported in the housing and which passes through the crank chamber;

a cylinder bore formed in the housing;

a piston, which is located in the cylinder bore;

a swash plate, which converts rotation of the drive shaft into reciprocation of the piston, connected to the piston;

a coil spring for urging the swash plate in the axial direction of the drive shaft;

a positioning structure for determining the position of one of two axial ends of a coil in relative to the housing or the drive shaft, wherein the coil spring has a large-diameter end and a small diameter end, the small-diameter end being opposite to the large-diameter end, wherein either the large-diameter end or the small-diameter end, serves as a fixed positioning end, wherein the support has an annular groove, which is substantially coaxial to the coil spring, wherein the positioning end engages the annular groove, which fixes the position of the positioning end, and wherein the positioning end is elastically urged toward the annular groove.

6. The compressor according to claim 5, wherein the annular groove has a circumferential surface that is coaxial to the coil spring, wherein the positioning end is elastically urged against the circumferential surface of the annular groove in the radial direction of the coil spring.

7. The positioning structure according to claim 5, wherein the support includes a bore, which accommodates the coil spring, wherein the annular groove is formed in the wall of the bore, wherein the diameter of the positioning end is constricted during installation so that the positioning end fits in the annular groove.

8. The compressor according to claim 5, wherein the annular groove is formed on the circumferential surface of the drive shaft, wherein the diameter of the positioning end is expanded during installation so that the positioning end fits in the annular groove.

9. The compressor according to claim 5, wherein the positioning end is constricted in the radial direction by the support.

* * * * *